US005104779A

United States Patent [19]

Säverin et al.

[11] Patent Number: 5,104,779

[45] Date of Patent: Apr. 14, 1992

[54] MULTIFUNCTIONAL LAYER FOR A PHOTOGRAPHIC ELEMENT AND A COATING

[75] Inventors: Eckehard Säverin, Osnabrück; Hans-Udo Tyrakowski, Hasbergen, both of Fed. Rep. of Germany

[73] Assignee: Felix Schoeller Jr GmbH & Co. KG, Osnabrück, Fed. Rep. of Germany

[21] Appl. No.: 380,212

[22] Filed: Jul. 14, 1989

Related U.S. Application Data

[63] Continuation-in-part of Ser. No. 141,925, Jan. 6, 1988, abandoned.

[30] Foreign Application Priority Data

Jan. 6, 1987 [DE] Fed. Rep. of Germany ..... 3700183

[51] Int. Cl.[5] ..... G03C 1/82

[52] U.S. Cl. ..... 430/527; 430/529; 430/551; 430/556

[58] Field of Search ..... 430/527, 529, 531, 536

[56] References Cited

U.S. PATENT DOCUMENTS

| | | | |
|---|---|---|---|
| 3,525,621 | 8/1970 | Miller | 430/529 |
| 3,791,831 | 2/1974 | von Bonin et al. | 430/529 |
| 4,225,665 | 9/1980 | Schadt, III | 430/529 |
| 4,418,141 | 11/1983 | Kawaguchi et al. | 430/527 |
| 4,585,730 | 4/1986 | Cho | 430/527 |
| 4,701,403 | 10/1987 | Miller | 430/529 |
| 4,703,000 | 10/1987 | Hodgins | 430/527 |

*Primary Examiner*—Jack P. Brammer
*Attorney, Agent, or Firm*—Horst M. Kasper

[57] ABSTRACT

The invention relates to a multifunctional back layer for a photographic element and to a coating composition for manufacturing the multifunctional layer which comprises at least four components: (a) a surface-hydroxylated aluminum-modified silica, (b) an alkali-metal salt of an organic polyacid, (c) an aqueous dispersion of copolymers of acrylic-acid-alkyl-ester including free carboxylic groups of from 1–10 mole-% and of free hydroxyl groups of from 5–20 mole-%, wherein the sum of free carboxylic groups and free hydroxy groups does not exceed 25 mole-%, and (d) a trifunctional aziridine as a cross-linking means. The multifunctional back layer of the photographic element according to the invention exhibits a low reception for dirt during passage through roller-transport developing machines, a high abrasion-proofness, wear resistance, stability in alkaline developer solutions, good printability during printing with conventional printing inks, good markability, inscriptability and lettering, as well as a good adhesive tape adhesion.

9 Claims, No Drawings

MULTIFUNCTIONAL LAYER FOR A PHOTOGRAPHIC ELEMENT AND A COATING

CROSS REFERENCE TO RELATED APPLICATION

This application is a continuation-in-part application of another application filed Jan. 6, 1988 and bearing Ser. No. 07/141,925 now abandoned. The entire disclosure of this latter application, including the drawings thereof, is hereby incorporated in this application as if fully set forth herein.

BACKGROUND OF THE INVENTION

1. Field of the Invention

The present invention relates to a multifunctional back layer for photographic elements.

2. Brief Description of the Background of the Invention Including Prior Art

In general, photographic elements consist of a support material and the photographic layers. Support materials are provided with one or more additional layers on their back in order to prevent, for example a curl or an accumulation of electrostatic charges on the surface during the processing of the material, i.e. during the wetting and casting with light-sensitive emulsions or also after the passage through the processing solutions during the sorting processes.

In addition to the recited antistatic properties, the back side layer of the photographic material is to meet simultaneously the following requirements:

(1) Low dirt reception during passage of the photographic material through roller-transport developing machines, where dirt films of the oxidation product of the developer deposit easily.

(2) An abrasion strength which is a high as possible and a stability in alkaline developer solutions which, for example, is important in the passage of the photographic material through a processing machine operating with rollers.

(3) Good printability during printing with conventional printing inks as well as good lettering capability.

(4) Good adhesive-tape adhesion since, during the passage of the photographic material through modern automatic developing machines, in each case, the next following roll is glued or adhesively attached to the preceding roll, and the adhesive attachment has to be assured during the passage of the adhesively attached junction through the developer processing solutions.

It is very difficult in practice to obtain these properties simultaneously, since the components known for such purpose influence the material properties in part in opposite ways. Hydrophobic components, for example, are associated with the disadvantage of a high acception for dirt and low antistatic effectiveness, while hydrophilic components result in a low adhesive-type attachment, poor printability, and insufficient strength in the processing solutions.

It is known that the static charting of the back side layer can be reduced by matting and dulling agents. Thereby, the adhesion of two photographic materials on one another is reduced. Furthermore, it is known that the already present static charging can be removed by incorporating electrically-conducting additives in the layer.

For example, photographic material with the silver halide emulsion layer on one side of a polyolefine-coated photographic support material and with another antistatic layer on the opposite side of the photographic support material is known from the U.S. Pat. No. 4,582,783, where the antistatic layer contains a sodium-magnesium silicate, a sodium-polystyrene-sulfonate, and certain succinic-acid-semi-esters. The conductivity of this combination is such that desired antistatic properties are sufficient. In addition, the material also exhibits a relatively low dirt acceptance. However, this is associated with losses relating to the other required properties.

Materials showing antistatic properties are in general soluble in water due to their ionic conductivity, or at least can swell in water. Thus, a good conductivity usually results in a bad adhesion of the layer during passage through the processing solutions. The good conductivity is associated with a reduced abrasion strength as well as a poorer adhesive-tape adhesion.

It is difficult in principle to obtain a photographic material which corresponds, with respect to all five properties recited above, to the requirements. Polar surfaces are in fact conductive (antistatic property) and exhibit a low reception for dirt, but with increasing polarity, the abrasion strength and the adhesive-tape adhesion decrease as a result of the processing solution's influence. On the other hand, an improvement of the adhesive-tape has led hitherto to conductivity decreases and to increased dirt acception to the photographic material.

SUMMARY OF THE INVENTION

1. Purposes of the Invention

It is an object of the present invention to provide a multifunctional layer for the back side of a photographic element of the kind recited above, whereby the layer at the same time exhibits good properties regarding low dirt acception, high abrasion stability, good printability, and good adhesive-tape attachment.

It is a further object of this invention to provide a coating composition for the manufacture of the multifunctional layer on photographic materials having exceptional properties.

These and other objects and advantages of the present invention will become evident from the description which follows.

2. Brief Description of the Invention

The present invention provides for a multifunctional layer and a coating composition for the manufacture of the multifunctional layer on the back side of a photographic element. A photographic element can comprise a support carrier sheet for a multifunctional layer such as paper, coated paper, cellophane, glass surface, plastic surfaces, and the like. The multifunctional layer comprises a surface-hydroxylated aluminum-modified silica, an alkali-metal salt of an organic polysulfonic acid or of an organic polysulfate, a water-insoluble copolymer of at least three components and forming an acrylic-acid-alkyl-esters with a content in free carboxylic groups of from 1–10 mole-% and in free hydroxy groups of from about 5–20 mole-%, wherein the sum of free carboxylic groups and free hydroxy groups does to exceed 25 mole-%, and a trifunctional aziridine as a cross-linking agent, and the coating composition for manufacturing the multifunctional layer comprises the said component in an aqueous dispersion.

Trifunctional aziridines are known as cross-linking agents for plastic dispersions containing free carboxylic groups.

As comparison tests have demonstrated, this back side layer according to the invention exhibits good antistatic properties, low dirt reception with respect to the mostly dark-colored oxidation products of developer solutions, good abrasion and water resistance during passage through acid and alkaline developer processing solutions, good printability with commercial printing inks and good lettering with felt-tip and ball-point pens, as well as good adhesive-tape attachment, even in case of a chemical or mechanical load. According to the invention, the sum of the polar groups in the copolymer, i.e. acid groups and hydroxy groups, does not exceed 25 mole-% of the copolymer.

The novel features which are considered as characteristic for the invention are set forth in the appended claims. The invention itself, however, both as to the composition of the layer and the coating composition, together with additional objects and advantages thereof, will be best understood from the following description of specific embodiments when read in connection with specific examples set forth in the accompanying Tables 1, 2, and 3.

DESCRIPTION OF INVENTION AND PREFERRED EMBODIMENT

In accordance with the present invention, there is provided a multifunctional layer composition and a coating composition to produce such layer on the back side of a photographic element, whereby the back side is the surface which is opposite to the image-developing front side.

The coating composition contains the following components:

- a colloidal surface-hydroxylated aluminum-modified silica,
- an alkali-metal salt of an organic polysulfonic acid or an organic polysulfate,
- an aqueous dispersion of a copolymer of at least three components and forming an acrylic-acid-alkyl-ester with a content in free carboxylic groups of from about 1–10 mole-% and in free hydroxy groups of from about 5–20 mole-%, and wherein the sum of free carboxylic groups and hydroxy groups does not exceed 25 mole-%, and
- a trifunctional aziridine as a cross-linking agent.

The copolymer can be a copolymer of at least one ($C_1$–$C_4$)-alkyl-acrylate, methyl-methacrylate, (meth)-acrylic acid and hydroxy-alkyl-acrylate.

The copolymer can furthermore be a copolymer of styrene, of at least one ($C_1$–$C_4$)-alkyl-acrylate, meth-acrylic acid and hydroxy-alkyl-acrylate. Or the copolymer can be a copolymer of styrene, methyl-methacrylate, at least one ($C_1$–$C_4$)-alkyl-acrylate, (meth)-acrylic acid and a hydroxy-alkyl-acrylate.

The copolymer can be a copolymer comprising at least one ($C_1$–$C_4$)-alkyl-acrylate, hydroxy-alkyl-acrylate and (meth)-acrylic acid.

The multifunctional layer as well as the coating composition can additionally comprise a sodium-magnesium-silicate of the montmorillonite type.

The alkali-metal salt of an organic polysulfonic-acid or of an organic polysulfate can be a lithium salt, a sodium slat or a potassium salt selected from the group consisting of polystyrene-sulfonic-acid, napththalene-sulfonic-acid, or alkali-cellulose-sulfate, and mixtures thereof.

The surface-hydroxylated aluminum modified silica is a colloidal dispersion of silica in aqueous media with a partial substitution of aluminum for silicon. Preferably, the following amount ratios by weight of the components are employed as referred to the resulting dry layer in each case:

| | |
|---|---|
| (a) surface-hydroxylated aluminum-modified silica | 23–70 weight-percent |
| (b) alkali-metal salt of an organic polysulfonic acid or of an organic polysulfate | 3–30 weight-percent |
| (c) copolymer according to invention | 30–70 weight-percent |
| (d) sodium-magnesium-silicate of the montmorillonite type | 0–30 weight-percent |
| (e) trifunctional aziridine | 2–18 weight-percent |

whereas these components amount to at least 85 weight-percent of the whole dry multifunctional layer.

The most preferred method for producing the coating composition comprises the slow mixing and agitating of the individual components in the following sequence:

solvent mixture, montmorillonite if desired, a colloidal aluminum-modified silica, an aqueous dispersion of copolymers of at least three components are forming an acrylic-acid-alkyl-ester with a content in free carboxylic groups of from about 1–10 mole-% and in free hydroxy groups of from about 5–20 mole-%, an alkali salt of an organic polyacid, a trifunctional aziridine as a cross-linking agent.

The desired pH-value of the coating composition is adjusted with an ammonia solution. The pH-value can be above 7 and is preferably above 8 and pH-values of more than 8.2 are employed in practical applications. The resultant coating composition is applied in the desired layer thickness and followed by drying.

According to a further advantageous embodiment of the invention, the effectiveness of the combination of the specific invention binder and the cross-linking agent by a sodium-magnesium silicate of the montmorillonite type additionally present in the multifunctional layer, is increased.

More preferred quantitative ratios of the components are referred in each case to the dry layer as follows:

| | |
|---|---|
| surface-hydroxylated aluminum-modified silica | 30–50 weight-percent |
| alkaline-metal salt of an organic sulfonic acid or of an organic sulfate | 10–20 weight-percent |
| copolymer of acrylic-acid-alkyl-ester | 40–50 weight-percent |
| sodium-magnesium-silicate of the montmorillonite type | 10–20 weight-percent |
| trifunctional aziridine | 5–12 weight-percent |

The coating thickness in the dry state is at 0.2–1.0 g/sq.m, and preferably between 0.2–0.5 g/sq.m.

The production of the multifunctional layer for photographic elements according to the invention is performed in particular in that the individual components are mixed under slow stirring in the sequence water-alcohol-mixture, sodium-magnesium silicate of the montmorillonite type if desired, colloidal surface hydroxylated aluminum-modified silica, copolymer dispersion, alkali-metal salt of the polysulfonic acid or of an organic polysulfate, aziridine, then the desired pH-value is set with ammonia solution, the thus resultant casting solution is applied in the desired layer thickness and a drying process is subsequently performed. The production is generally performed at about ambient temperature.

The support material can be a polyolefine-coated paper. The support material is preferably a sized and resin-coated photographic paper, in particular a paper treated according to the disclosure under U.S. Pat. application, Ser. No. 07/077,491, filed July 24, 1987.

The testing of the antistatic properties is performed by measuring the surface resistivity with an electrode according to German Industrial Standard DIN 53482.

In order to test the printability and the abrasion strength and the processing solution's stability, samples are printed up with commercially available color tapes. After printed, the samples were dipped for 30 seconds in a commercial developer after printing and were briefly rinsed with water for testing the samples with regard to chemical and mechanical loads that occurred during the development process. Subsequently, frictions were applied with the finger on the printed back side. It is being tested whether this results in a smearing of the print or whether color changes occur by leaching or washing out of one color component of the printing color or ink. A smeared print after a developer bath and friction results either from a poor adhesion of the print on the back side of the photographic material or from a poor abrasion strength of the back side coating. The latter, as well as damages by abrasion of the back side surface can be recognized upon viewing in contre-jour (counter-light).

For checking the adhesive-tape adhesion, the sample is providing with a commercial adhesive tape, for example 3M adhesive tape 8422, and this is fixed with a defined weight (8-kg roll). The sample is subsequently cut into strips having a width of 1.5 cm and the adhesive tape is in part pulled of. The thus prepared sample is tensioned in a tensile tester, wherein the adhesive tape is pulled off the support surface at an angle of 180 degrees and at a speed of 20 cm/min. The force required for the pulling off is determined. Since the adhesion of the adhesive tape has to be sufficient, even in case of a mechanical load in the developing solutions, before pulling off of the adhesive tape, a drop of water is placed at the boundary between the photographic material and the adhesive tape.

For testing the dirt-reception capabilities, two test methods different color developer and different preliminary treatment of the color developer are used:

Dirt Reception Test Method I:

A commercial European color developer is filled into an open disk with a filling height of approximately 2 cm and is left standing in the air for more than one week. After this period, a dark tar layer has formed at the surface comprising oxidation products. This tar-like surface is stripped with the sample to be tested. The sample is subsequently washed off under running water and air-dried. The extent of the acceptance of the dirt can be determined visually fairly accurately by the discoloring on the back side.

Dirt Reception Test Method II:

A commercial Americal color developer (Hunt Phase III) is filled into an open vessel and stirred heavily for 5 hours at 40° C. After this period, oxidation products have formed. The samples are dipped into the oxidized developer solution and subsequently washed off under running water and air-dried. The extent of the acceptance of the dirt can be determined visually fairly accurately by the discoloring on the back side.

The following Table I contains, by way of example, compositions of mixtures for obtaining the multifunctional layers according to the invention. The corresponding testing values have been collected in Table 3.

Aziridines are based on the ring structure

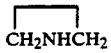

including ethylene imine, which is aziridine itself, ethylethylene imine, propylene imine, polypropylene imine, 1-aziridine ethanol. In general, aziridines can have one nitrogen N-atom or two nitrogen N-atoms in a three-membered ring. They can be saturated or unsaturated and should have at least three functional groups. In particular, the aziridine compounds employed according to the invention can contain multiple and preferably more than two and less than seven aziridine sections, where the three functional groups required are provided by individual aziridine sections of the aziridine compounds. Examples for aziridine compounds, useful in the context of the present invention, are provided by their chemical structure formula in the following tables.

It will be understood that each of the elements described above, or two or more together, may also find a useful application in other types of paper production system and coating composition procedures differing from the types described above.

While the invention has been illustrated and described as embodied in the context of a multifunctional layer for a photographic element and a coating composition, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

TABLE 1

| | Comparisons | | Examples | | | | | | | |
|---|---|---|---|---|---|---|---|---|---|---|
| | 1 | 2 | 1 | 2 | 3 | 4 | 5 | 6 | 7 | 8 |
| Sodium-magnesium-silicate of the montmorillonite type 10 weight-% in water | — | 5 | 5 | — | 15 | — | 5 | 10 | — | 5 |
| Colloidal surface hydroxylated aluminum modified silica | 18 | 10 | 8 | 10 | 5 | 10 | 10 | 8 | 18 | 10 |

TABLE 1-continued

| | Comparisons | | Examples | | | | | | | |
|---|---|---|---|---|---|---|---|---|---|---|
| | 1 | 2 | 1 | 2 | 3 | 4 | 5 | 6 | 7 | 8 |
| (Ludox AM, DuPont) | | | | | | | | | | |
| Copolymer dispersion 1 (30%) | 9 | 8 | — | — | — | — | — | — | — | — |
| Copolymer dispersion 2 (30%) | — | — | 15 | 10 | — | — | — | — | — | — |
| Copolymer dispersion 3 (30%) | — | — | — | — | 8 | 10 | — | — | — | — |
| Copolymer dispersion 4 (30%) | — | — | — | — | — | — | 10 | 12 | — | — |
| Copolymer dispersion 5 (30%) | — | — | — | — | — | — | — | — | 9 | 8 |
| Trifunctional aziridine, 50% in IPA | 0.3 | 0.3 | 0.15 | 0.1 | 0.25 | 0.3 | 0.25 | 0.3 | 0.3 | 0.3 |
| Sodium-polystyrene-sulfonate, 30% in water | — | 1.0 | 5.0 | — | 1.0 | 2.0 | — | 1.5 | — | 1.0 |
| Sodium-cellulose-sulfate, 10% in water | 3.5 | — | — | — | — | — | 3.0 | — | 3.5 | — |
| Sodium-naphthalene-sulfonate, 30% in water | — | — | — | 5.0 | — | — | — | — | — | — |
| Ammonia solution, up to pH | 8.0 | 8.4 | 8.4 | 8.4 | 8.4 | 8.0 | 8.4 | 8.4 | 8.4 | 8.4 |
| Water-alcohol mixture (10:1) | 69 | 76 | 67 | 75 | 71 | 78 | 72 | 68 | 69 | 76 |

Copolymer 1: comparison-Butyl acrylate:styrene:methacrylic acid = 45:45:10
Copolymer 2: example-Butyl acrylate:methyl-methacrylate:methacrylic acid:hydroxy-ethyl-acrylate = 68:10:2:20
Copolymer 3: example-Butyl acrylate:methyl-methacrylate:ethyl-acrylate:methacrylic acid:hydroxy-ethyl-acrylate = 53:10:20:7:10
Copolymer 4: example-Butyl-acrylate:methyl-methacrylate:hydroxy-ethyl-acrylate:methacrylic acid = 50:30:5:15
Copolymer 5: example-Butyl-acrylate:styrene:methacrylic acid:hydroxy-ethyl-acrylate = 45:40:10:5

TABLE 2

The following comparison examples were selected:
Comparison Example A = U.S. 4,582,783, Example 2.1
Comparison Example B = U.S. 4,582,783, Example 2.5
Comparison Example C = U.S. 4,582,783, Comparison Example with polybutyl-acrylate

| | | Comparison Examples according U.S. 4,582,783 | | |
|---|---|---|---|---|
| | | A | B | C |
| Sodium magnesium silicate | (10%) | 18.4% | 4.0% | 12.3% |
| Succinic acid semi-ester | (16.8%) | 12.0% | 9.0% | — |
| Polystyrene sulfonic acid sodium | (5%) | 3.3% | 16.0% | 4.4% |
| Dodecylbenzene sulfonic acid sodium | (4%) | 1.6% | 2.7% | 1.6% |
| Deionized water | | 64.7% | 68.3% | 72.9% |

TABLE 2-continued

The following comparison examples were selected:
Comparison Example A = U.S. 4,582,783, Example 2.1
Comparison Example B = U.S. 4,582,783, Example 2.5
Comparison Example C = U.S. 4,582,783, Comparison Example with polybutyl-acrylate

| | | Comparison Examples according U.S. 4,582,783 | | |
|---|---|---|---|---|
| | | A | B | C |
| Polybutylacrylate | (30%) | — | — | 8.8% |

(% = weight-percent)

TABLE 3

| | Test Results | | | | | | |
|---|---|---|---|---|---|---|---|
| | Surface Resistance (Ω/sq.cm) | | | | | | |
| | Before Passage Through Baths | After Passage Through Baths | Adhesive-Tape Adhesion (kNm) | Reception of Dirt Test Method I | Reception of Dirt Test Method II | Print Picture After Bath Reaction | Bath and Abrasion Strength |
| Comparison 1 | $2 \cdot 10^{10}$ | $8 \cdot 10^{10}$ | 3.4 | med. | high | good | good |
| Comparison 2 | $6 \cdot 10^{9}$ | $1 \cdot 10^{11}$ | 3.1 | med. | high | good | good |
| Example 1 | $8 \cdot 10^{9}$ | $8 \cdot 10^{10}$ | 2.5 | low | low | good | satisf. |
| Example 2 | $2 \cdot 10^{9}$ | $9 \cdot 10^{10}$ | 2.3 | low | low | good | satisf. |
| Example 3 | $5 \cdot 10^{9}$ | $9 \cdot 10^{10}$ | 3.0 | med. | med. | good | good |
| Example 4 | $8 \cdot 10^{8}$ | $6 \cdot 10^{10}$ | 3.1 | med. | med. | good | good |
| Example 5 | $9 \cdot 10^{9}$ | $2 \cdot 10^{11}$ | 3.2 | low | med. | good | good |
| Example 6 | $3 \cdot 10^{9}$ | $1 \cdot 10^{11}$ | 2.9 | med. | low | good | good |
| Example 7 | $8 \cdot 10^{9}$ | $4 \cdot 10^{10}$ | 2.9 | med. | med. | good | good |
| Example 8 | $5 \cdot 10^{9}$ | $1 \cdot 10^{11}$ | 2.8 | med. | med. | good | good |
| Comparison Example A | $2 \cdot 10^{9}$ | $1 \cdot 10^{11}$ | 0.1 | low | med. | satisf. | fair |
| Comparison Example B | $8 \cdot 10^{8}$ | $3 \cdot 10^{11}$ | 0.1 | low | med. | satisf. | fair |
| Comparison Example C | $3 \cdot 10^{9}$ | $8 \cdot 10^{11}$ | 3.1 | high | high | good | fair |

EXAMPLES OF TRI-FUCTIONAL AZIRIDINES

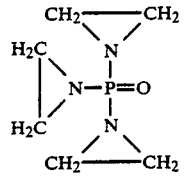

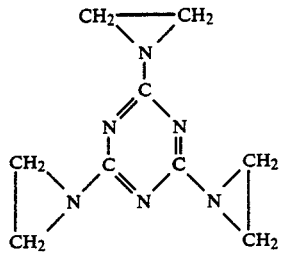

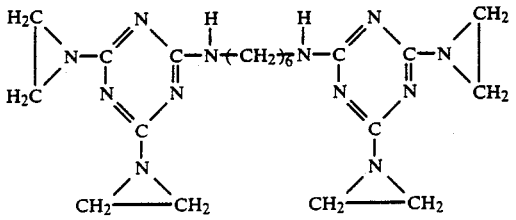

We claim:

1. A multifunctional layer to be disposed on the back side of a photographic element, whereby the back side is the surface which is opposite to the image developing front side, wherein the multifunctional layer consist essentially the following components or reaction products of these components:

a surface-hydroxylated aluminum-modified silica in an amount of from about 23 to 70 weight percent;

an alkali-metal salt of an organic polysulfonic acid or of an organic polysulfate in an amount of from about 3 to 30 weight percent;

a copolymer made of at least three components and forming an acrylic-acid-alkyl-ester including free carboxylic groups of from about 1–10 mole-%, free hydroxyl groups of from about 5–20 mole-%, and wherein the sum of free carboxylic groups and of free hydroxyl groups does not exceed 25 mole-%, wherein the copolymer amounts to from about 30 to 70 weight percent;

a trifunctional aziridine as a crosslinking agent in an amount from about 2 to 18 weight percent, wherein all weight percentages refer to the dry layer.

2. The multifunctional layer according to claim 1, wherein the multifunctional layer additionally contains a sodium-magnesium-silicate of the montmorillonite type.

3. The multifunctional layer according to claim 1, wherein the alkali-metal salt of an organic polysulfonic acid or of an organic polysulfate is a lithium salt, sodium salt, or potassium salt selected from the group consisting of polystyrene-sulfonic-acid, naphthalene-sulfonic-acid, or cellulose-sulfate.

4. The multifunctional layer according to claim 1, wherein the following amount ratio by weight of the compounds refers to the dry layer:

sodium-magnesium-silicate of the montmorillonite type in an amount of up to 30 weight-percent, and wherein the components amount to at least 85 weight-percent of the whole multifunctional layer.

5. The multifunctional layer according to claim 1, wherein the copolymer is a copolymer of

| | |
|---|---|
| 35–75 mole-% | ($C_1$–$C_4$)-alkyl-acrylate, |
| 1–10 mole-% | methacrylic-acid, |
| 5–20 mole-% | hydroxy-alkyl-acrylate, and |
| 0–40 mole-% | styrene and/or methyl-methacrylate. |

6. The multifunctional layer according to claim 5, wherein the multifunctional layer additionally contains a sodium-magnesium-silicate of the montmorillonite type.

7. The multifunctional layer according to claim 5, wherein the alkali-metal salt of an organic polysulfonic acid or of an organic polysulfate is a lithium salt, a sodium salt, or a potassium salt selected from the group consisting of polystyrene-sulfonic acid, naphthalene-sulfonic-acid or cellulose-sulfate.

8. The multifunctional layer according to claim 5, wherein the following amount ratio by weight of are, in each case, as the component refers to the dry layer;

sodium-magnesium-silicate of the montmorillonite type in an amount of up to 30 weight-percent and wherein the components amount to at least 85 weight-percent of the whole multifunctional layer.

9. An antistatic, tape adhesionable, printable, abrasion resistant and photographic-baths-resistant layer to be disposed on the back (reverse) side of a photographic element, whereby the back side is the surface which is opposite to the image developing front side, wherein said layer consist essentially of the following components or reaction products of these components:

surface-hydroxylated aluminum modified silica 23–70 weight-percent alkali-metal salt of an organic polysulfonic acid or of an organic polysulfate 3–30 weight-percent copolymer of at least three components and forming acrylic-acid-alkyl-ester including free carboxylic groups of form about 1–10 mole-% and free hydroxyl groups of from about 5–20 mole-%, wherein the sum of free carboxylic groups and of free hydroxyl groups does not exceed 25 mole-% of acrylic-acid-alkyl-ester 30–70 weight-percent sodium-magnesium-silicate of the montmorillonite type 0–30 weight percent trifunctional aziridine 2–18 weight-percent wherein these components amount to at least 85 weight-percent of the whole dry layer.

* * * * *